US009058908B2

(12) United States Patent
Zhuikov et al.

(10) Patent No.: US 9,058,908 B2
(45) Date of Patent: Jun. 16, 2015

(54) METHOD FOR PRODUCING ACTINIUM-225 AND ISOTOPES OF RADIUM AND TARGET FOR IMPLEMENTING SAME

(75) Inventors: Boris Leonidovich Zhuikov, Troitsk (RU); Stepan Nikolaevich Kalmykov, Moscow (RU); Ramiz Avtandilovich Aliev, st. Vnukovo (RU); Stanislav Viktorovich Ermolaev, Mytischi (RU); Vladimir Mikhailovich Kokhanyuk, Naro-Forminsk (RU); Nikolai Alexandrovich Konyakhin, Obninsk (RU); Ivan Gundarovich Tananaev, Moscow (RU); Boris Fedorovich Myasoedov, Moscow (RU)

(73) Assignees: UCHREZHDENIE ROSSIISKOI AKADEMII NAUK INSTITUT YADERNYKH ISSLEDOVANY RAN (IYAI RAN), Moscow (RU); GOSUDARSTVENNOE UCHEBNO-NAUCHNOE UCHREZHDENIE KHIMICHESKY FAKULTET MGU IM. M.V. LOMONOSOVA, Moscow (RU)

( * ) Notice: Subject to any disclaimer, the term of this patent is extended or adjusted under 35 U.S.C. 154(b) by 894 days.

(21) Appl. No.: 13/120,186

(22) PCT Filed: Sep. 9, 2009

(86) PCT No.: PCT/RU2009/000462

§ 371 (c)(1), (2), (4) Date: May 24, 2011

(87) PCT Pub. No.: WO2010/036145

PCT Pub. Date: Apr. 1, 2010

(65) Prior Publication Data

US 2011/0317795 A1 Dec. 29, 2011

(30) Foreign Application Priority Data

Sep. 23, 2008 (RU) ..... 2008137558

(51) Int. Cl.
*G21G 1/00* (2006.01)
*G21G 1/12* (2006.01)

(52) U.S. Cl.
CPC ..... *G21G 1/12* (2013.01); *G21G 1/001* (2013.01); *G21G 2001/0089* (2013.01)

(58) Field of Classification Search
CPC ..... G21G 1/00; G21B 1/19; H05H 6/00; H05H 1/22
USPC ..... 376/151
See application file for complete search history.

(56) References Cited

U.S. PATENT DOCUMENTS 4,664,869 A 5/1987 Mirzadeh et al.
6,299,666 B1 10/2001 Apostolidis et al.

(Continued)

FOREIGN PATENT DOCUMENTS

EP 0752710 A1 1/1997
EP 0962942 A1 12/1999

(Continued)

OTHER PUBLICATIONS

Gauvin, Heri, "Reactions (p,2pxn) on Thorium-232 at 30 to 120McV", Physics Journal, vol. 26, Nov. 1963, pp. 836-838.

(Continued)

*Primary Examiner* — Jack W Keith
*Assistant Examiner* — Sean P Burke
(74) *Attorney, Agent, or Firm* — Ladas & Parry LLP

(57) ABSTRACT

The invention relates to the field of nuclear technology and radiochemistry, more specifically to the production and isolation of radionuclides for medical purposes. The method for producing actinium-225 and isotopes of radium comprises irradiating a solid block of metallic thorium of a thickness of 2 to 30 mm, which is contained within a hermetically sealed casing made of a material which does not react with thorium, with a flow of accelerated charged particles with high intensity. The irradiated metallic thorium is removed from the casing and is either heated with the addition of lanthanum and the distillation of radium or is dissolved in nitric acid with the recovery of actinium-225 by extraction. A target for implementing this method consists of blocks of metallic thorium of a thickness of 2 to 30 mm, which are contained within a hermetically scaled casing made of different materials which do not react with thorium.

6 Claims, 12 Drawing Sheets

(56) References Cited

U.S. PATENT DOCUMENTS

| | | | | |
|---|---|---|---|---|
| 8,249,210 | B2 * | 8/2012 | Schedler et al. | 376/100 |
| 2006/0072698 | A1 * | 4/2006 | Morgenstern et al. | 376/194 |
| 2011/0216867 | A1 * | 9/2011 | Srivastava et al. | 376/151 |

FOREIGN PATENT DOCUMENTS

| | | | |
|---|---|---|---|
| RU | 2199165 | C1 | 2/2003 |
| RU | 2200581 | C1 | 3/2003 |
| RU | 2006139624 | A | 5/2008 |

OTHER PUBLICATIONS

Leford, M., et al., "Reactions Nucleaires De Spallation Induites Sur Le Thorium Par Des Protons De 150 ET 82 MeV", Nuclear Physics 25 (1961), pp. 216-247 and English abstract.

Henriksen, G., et al., "Ra for endoradiotherapeutic applications prepared from an immobilized $^{227}Ac/^{227}Th$ source", Radiochim. Acta 82, (2001), pp. 661-666.

Moskvin, L.N., et al., "Isolation of Actinium and Radium from Thorium Target Irradiated by 600 MeV Protons", Atomnaya Energiya, vol. 24, No. 4, Apr. 1968, pp. 383-384 and English translation.

* cited by examiner

METHOD FOR PRODUCING ACTINIUM-225 AND ISOTOPES OF RADIUM AND TARGET FOR IMPLEMENTING SAME

FIELD OF THE ART

The invention relates to nuclear technology and radiochemistry, namely, to the production and recovery of radionuclides for medicinal purposes. Specifically, the invention concerns the production of actinium-235 and radium isotopes (radium-223, as well as radium-224 and radium-225) for use in alpha-therapy and as precursors for producing other short-lived daughter isotopes (for example, bismuth-213, lead-211, and bismuth-211), which are likewise useful for treating oncologic diseases.

BACKGROUND OF THE INVENTION

A process is known for preparing actinium-235 from thorium-229 and daughter fission products, this process comprising the dissolution of a sample in a nitric acid solution and the ion-exchange recovery of actinium-235 from parent thorium-229 [RU No. 2200581].

A drawback of this process is a limited availability of the raw material (thorium-229), which is in turn produced from uranium-233. Therefore, potential productions are not high.

Another process for producing actinium-235 comprises the irradiation of targets made of radium salts with protons in a cyclotron followed by ion-exchange separation of actinium and radium [U.S. Pat. No. 6,299,666 B1].

A drawback of this process consists of the hazard of radium salts. Further, they have high thermal conductivities and thereby cannot be irradiated with high currents. Furthermore, these targets have high costs, and radium regeneration is thereby necessary.

One more process for producing actinium-235 comprises the irradiation of targets containing metallic thorium with proton beams having energies higher than 40 MeV, dissolution of irradiated thorium in nitric acid, and subsequent recovery of actinium-235 from the solution. Thorium and newly formed protactinium were separated front actinium and radium by means of precipitation in the form of iodates, and actinium was separated from radium by extraction with thenoyl trifluoroacetate [see H. Gauvin, Reactions (p, 2pxn) sur le thorium 232 de 30 a 120 MeV, Journal de Physique, Vol. 24, pp. 836-838, 1963]. This process fails to provide the recovery of actinium from thorium targets of large weights and targets containing large amounts of isotopes of other elements generated by proton bombardment.

The most pertinent art consists of the process for producing actinium-235, this process comprising the irradiation of targets containing metallic thorium in the form of a foil with protons in a cyclotron, the dissolution of targets in a nitric acid solution, and recovery of actinium [see M. Lefort et al., Reactions nucleaires de spallation induites sur le thorium par des protons de 150 et 82 MeV, Nuclear Physics, Vol. 25, pp. 216-247, 1961].

A drawback of this process consists of small weights of the thorium targets used (foil thicknesses are up to 0.05 mm), which cannot provide high yields of actinium. Chemical recovery methods are practically unsuitable for processing high-activity thorium targets of great weights for producing large amounts of $^{225}$Ac. Further, the process does not provide refining of actinium from a number of foreign isotopes which are generated in large amounts in a proton-irradiated thorium target, and thereby cannot provide a high purity of the final products.

A process for producing radium isotopes comprises chemical recovery from a small weight amount of $^{227}$Th (having a half-life period of 18.7 days), which is in turn produced by decay of $^{235}$/($7\times10^8$ years)→$^{231}$Pa (32,800 years) $^{227}$Ac (28 years) [see G. Henriksen et al., $^{223}$Ra for Endoradiotherapeutic Applications Prepared from Immobilized $^{227}$Ac/$^{227}$Th Source, Radiochim. Acta, Vol. 89, pp. 661-666, 2001].

A drawback of this process consists of the following: the amount of $^{227}$Ac that can be recovered from natural uranium-235 is small; in producing $^{227}$Ac by irradiation of a $^{226}$Ra target in a nuclear reactor, the target is dangerous to handle, has a high cost, and is not easily accessible, thereby requiring radium regeneration after irradiation and refining from numerous radioactive fission products.

Another process for producing radium isotopes comprises the irradiation of targets containing metallic thorium in the form of a foil with protons in a cyclotron, the dissolution of targets in a nitric acid solution, and recovery of radium [see. M. Lefort et al., Reactions nucleaires de spallation induites sur in thorium par des protons de 150 et 82 MeV, Nuclear Physics, Vol. 25, pp. 216-247, 1961].

A drawback of this process also consists of small weights of the thorium targets used (foil thicknesses are up to 0.05 mm), which cannot provide high yields of radium. Chemical recovery methods are also practically unsuitable for processing high-activity thorium targets of great weights for producing large amounts of radium isotopes ($^{223}$Ra, $^{225}$Ra, and $^{224}$Ra). Further, the process does not provide refining of radium from some foreign isotopes which are generated in large amounts in a proton-irradiated thorium target, and cannot provide a high purity of the final products.

The most pertinent art is the process for producing radium isotopes, comprising the irradiation of thorium metal containing targets with beams of accelerated charged particles [see L. N. Moskvin and L. G. Tsaritsyna, Recovery of Actinium and Radium from a Thorium Target Irradiated with 660-MeV Protons, At. En., Vol. 24, pp. 383-384, 1968]. In order to recover radium isotopes, a thorium target was first dissolved in nitric acid, and the solution provided by thorium dissolution was admitted to a column packed with a sorbent coated with tributyl phosphate. Thorium, protactinium, zirconium, hafnium, and niobium were retained in the column, whereas actinium, radium, alkali elements, and alkaline-earth elements passed through it. Additional separation of radium from actinium, together with other alkaline-earth elements, was performed on a column packed with a sorbent coated with di-2-ethylhexylphosphoric acid.

A drawback of this process consists of the following: with use of bulky thorium targets in producing considerable amounts of radium, the precipitation of thorium will require very large columns. Further, the process does not provide the purification of radium from other alkaline-earth elements and from other fission products.

A target is known for use in the production of Rn, Xe, At, and I radioisotopes, this target comprising a thorium-238 sample to be irradiated wrapped in an aluminum foil [see U.S. Pat. No. 4,664,869].

A drawback of this target consists of small weights of the thorium targets used (of about 1 g), which cannot provide high activity yields of actinium and radium.

Another target is known for use in the production of actinium-235 and radium isotopes comprising a thorium metal target designed as a foil [see M. Lefort et al., Reactions nucleaires de spallation induites sur le thorium par des protons de 150 et 82 MeV, Nuclear Physics, Vol. 25, pp. 216-247, 1961].

A drawback of this target consists of small weights of the thorium targets used (foil thicknesses are up to 0.05 mm), which cannot provide high activity yields of actinium and radium.

Targets made of radioactive materials which are cooled while being irradiated in an accelerator or a reactor are, as a rule, enclosed in air-tight shells.

The most pertinent art consists of a target that comprises a thorium metal sample to be irradiated enclosed in an air-tight shell which is cooled with a liquid during irradiation [see US 2006/0072698, 2006].

A drawback of this target consists of the following: it is purposed for being irradiated with low-energy protons (below 40 MeV) and should have a relatively small thickness, and the material of the target shell (aluminum or silver) can melt or degrade when exposed to an intense beam of charged particles on account of interaction with thorium or a cooling liquid agent (aluminum); further, the target and shell thicknesses are not defined and it is not specified how the shell can be made air tight. Furthermore, real experimental data are not given in this reference.

The objects of the present invention are to solve the aforementioned problems by means of irradiating a thick (up to several centimeters) target of thorium metal with a high (tens of microampers) current of a charged particle beam and to separate pure actinium and radium from thorium and generated radioactive isotopes of various elements, such as protactinium, cesium, strontium, lanthanum, barium, zirconium, niobium, iodine, ruthenium, rhodium, antimony, and others. The technical result provided by the invention consists of an enhancement of yields of actinium-235, radium-223, and other radium isotopes.

DISCLOSURE OF THE INVENTION

One object of the invention is attained as follows: in the process for producing actinium-235, comprising the irradiation of thorium metal containing targets with a proton beam having an energy of above 40 MeV, the dissolution of irradiated thorium metal in nitric acid, and subsequent recovery of actinium-235 from the solution, thorium metal in the form of one or more bulk monoliths 2 to 30 mm thick is enclosed, prior to irradiation, into an air-tight shell made of a material that does not react with thorium under high thermal and radiation loads; the Irradiation is carried out with a high-intensity (of tens of microampers) beam of accelerated charged particles; the irradiated metallic thorium is withdrawn from the shell and then dissolved in a 7 to 10 molar excess of concentrated nitric acid; the medium is brought to 3 to 8 M nitric acid; and tributyl phosphate, or a 0.1 to 0.5 M solution of tri-n-octylphosphine oxide in an apolar organic solvent, or a 1 to 5 M solution of tributyl phosphate in an apolar organic solvent is added as an extracting agent, wherein extraction is carried out at least twice. Following the extraction, the solution is separated into an aqueous phase and an organic phase, the aqueous phase is concentrated to dryness, concentrated perchloric acid or another oxidizing agent is added, again concentrated to dryness, the residue is dissolved in 3 to 8 M nitric acid, admitted to a chromatographic column which is packed with an extraction/chromatographic sorbent, coated with a carbamoylphosphine oxide layer, the column is washed with 3 to 8 M nitric acid, and then actinium is eluted with 3 to 8 M nitric acid, wherein the chromatographic purification is carried out at least twice.

Herein, as the material of the air-tight shell of the target that does not react with thorium or the cooling liquid under high thermal or radiation loads, used is metallic niobium or high-alloy austenitic steel; or as the material of the air-tight shell of the target that does not react with thorium or the cooling liquid under high thermal or radiation loads, used is hot-rolled molybdenum, wherein the air-tight shell of hot-rolled molybdenum is coated on its outer surface with a protective layer of metallic nickel; or as the material of the air-tight shell of the target that does not react with thorium or the cooling liquid under high thermal or radiation loads, used is nonporous graphite, wherein the air-tight shell of nonporous graphite is coated on its outer surface with a protective layer of metallic nickel.

A preferred apolar organic solvent is toluene, or benzene, or xylene; other useful oxidizing agents are compounds of hypochloric acid or hypobromic acid; the chromatographic purification is preceded by the dissolution of the residue preferably in 3 to 8 M nitric acid, in a volume of 0.5 to 20 ml; and the height of the extraction/chromatographic sorbent bed in the chromatographic column is in the range from 3 to 15 cm and the diameter is in the range from 0.3 to 1.5 cm, wherein the extraction/chromatographic sorbent is washed with 3 to 8 M nitric acid, in a volume of 5 to 30 ml, and actinium is eluted from the extraction/chromatographic sorbent with 3 to 8 M nitric acid in a volume of 5 to 40 ml.

Another object of the invention is attained as follows: in the process for producing radium isotopes, comprising the irradiation of thorium metal containing targets with a beam of accelerated charged particles, thorium metal in the form of one or more bulk monoliths 2 to 30 mm thick is enclosed, prior to irradiation, into an air-tight shell made of a material that does not react with thorium under high thermal and radiation loads; irradiation is carried out with a high-intensity (of tens of microampers) beam of accelerated charged particles; the irradiated metallic thorium is withdrawn from the shell and transferred to a container made of metallic titanium or metallic zirconium, wherein metallic lanthanum is added to the container so that the percentage whereof with respect to thorium is in the range of no lower than 30 atomic %, a thorium and lanthanum melt in the container is heated at a temperature ranging from 1100 to 1300° C. in a flow of a purified inert gas, and then sublimed radium is precipitated on the surface of a collector which is made of metallic titanium or metallic zirconium at a temperature of from 600 to 700° C., preferably at 650° C., then washed off the collector's surface with 6 to 8 M nitric acid and passed through a chromatographic column packed with a crown ether based sorbent, and then radium is eluted with 4 to 8 M nitric acid.

One more object of the invention is attained as follows: in the target for implementing the process for producing actinium-235 and radium isotopes, this target comprising a thorium metal sample to be irradiated enclosed in an air-tight shell which is cooled during irradiation, the sample to be irradiated is designed in the form of one or more bulk thorium metal monoliths 2 to 30 mm thick; the air-tight shell is made of metallic niobium, or hot-rolled molybdenum, or high-alloy austenitic steel; the wall thickness of the air-tight shell on the beam inlet and outlet side is in the range from 50 to 300 μm; the walls of the air-tight shell are diffusion-welded to the irradiated sample and are additionally sealed by electron-beam, laser, or argon-arc welding.

Further, the air-tight shell may be made of nonporous graphite and the wall thickness of the air-tight shell on the beam inlet and outlet side may be in the range from 0.5 to 1.5 mm.

Herein, a protective layer of metallic nickel the thickness whereof falls in the range from 40 to 90 μm is made on top of the air-tight shell of hot-rolled molybdenum or graphite.

BRIEF DESCRIPTION OF THE DRAWINGS

The matter of the invention will now be described with reference to the schemes shown in FIGS. 1 and 2 which demonstrate the sequence of steps for recovering actinium-235 and radium isotopes, respectively, from an irradiated thorium target, and by drawings which schematically show the general view of the preferred embodiments of the target.

FIG. 4 shows an embodiment of the target having a non-porous graphite shell to be irradiated with an accelerator proton beam at an angle of 26°, wherein:

(1) is the case of the graphite shell coated with metallic nickel on its outer surface;

(2) is bulk thorium metal monoliths shaped as rectangular blocks;

(3) is a graphite cover of the target sealed with a radiation-resistant adhesive;

(4) is the proton-irradiated field.

Figure 5:
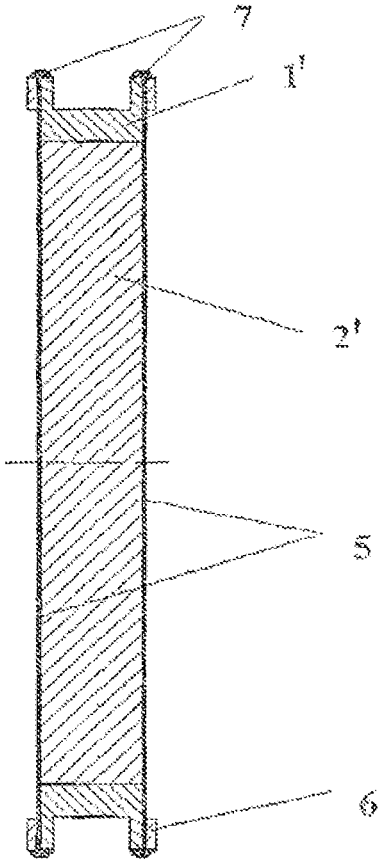

FIG. 5 shows an embodiment of the target having a metallic shell to be irradiated with a proton beam at a right angle, wherein:

(1') is the case of the shell made of niobium or hot-rolled molybdenum coated with nickel;

(2') is the bulk thorium metal monolith shaped as a disk diffusion welded to windows;

(50 is the beam inlet (outlet) window, which is a foil 100 μm thick made of niobium or molybdenum coated with nickel;

(6) are hardening niobium or molybdenum rings;

(7) is electron-beam or laser welding seam.

Figure 6:
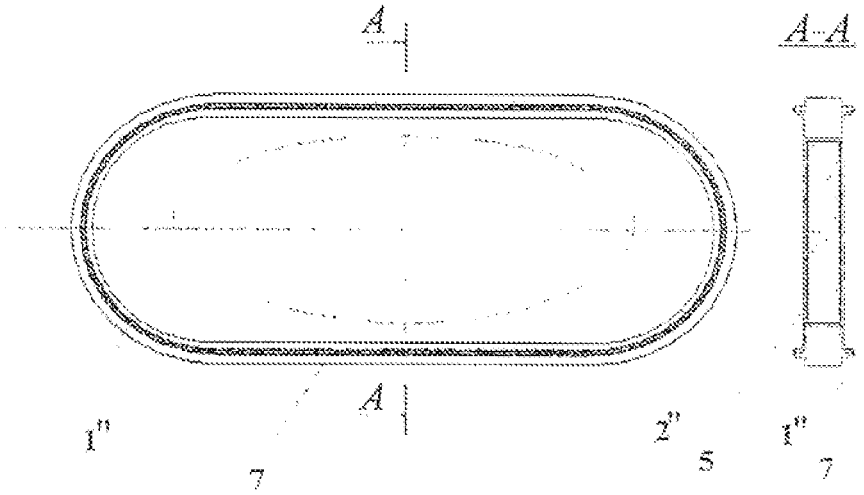

FIG. 6 shows an embodiment of the target having a stainless steel shell to be irradiated with a proton beam at an angle of 26', wherein:

(1") is the case of the shell made of austenitic stainless steel;

(2") the bulk thorium metal monolith shaped as an elliptic plate;

(5) the beam inlet;

(7) argon-arc welding seam.

Figure 7:
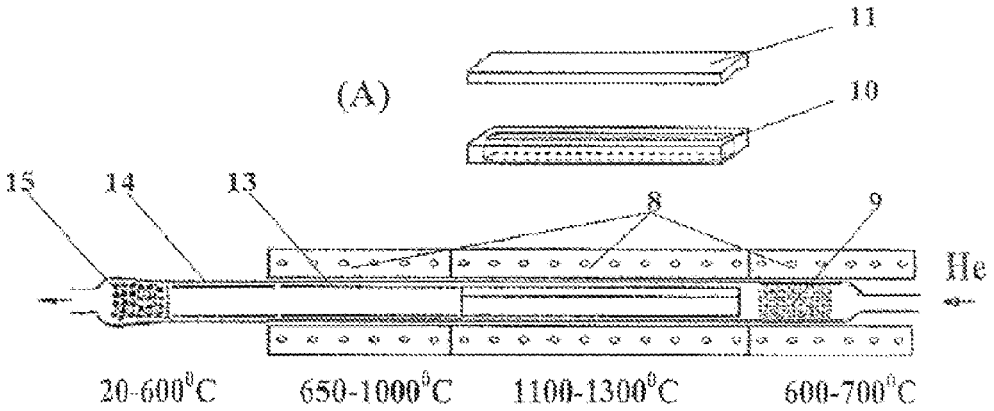
Figure 7:
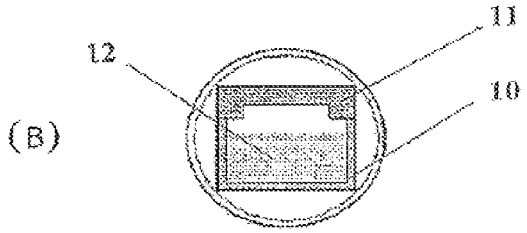

FIG. 7 shows an embodiment of the setup for the gas-chemical processing of thorium and recovery of radium, wherein:

(A) is a lateral view of the setup and the container to be placed therein, with temperature ranges for zones indicated;

(B) is a section of a quartz tube lined with a niobium foil in the center of the setup;

(8) are tubular resistor furnaces;

(9) is zirconium getter for purifying the inert gas;

(10) is a boat container made of metallic titanium or zirconium;

(11) is the cover of the titanium or zirconium container;

(12) is a melt of thorium with lanthanum;

(13) is a titanium foil serving as a collector for Ra, Sr, and Ba;

(14) is a collector foil for other sublimed elements (Cd, Cs, I, and Br);

(15) is an active carbon filter.

Figure 8:
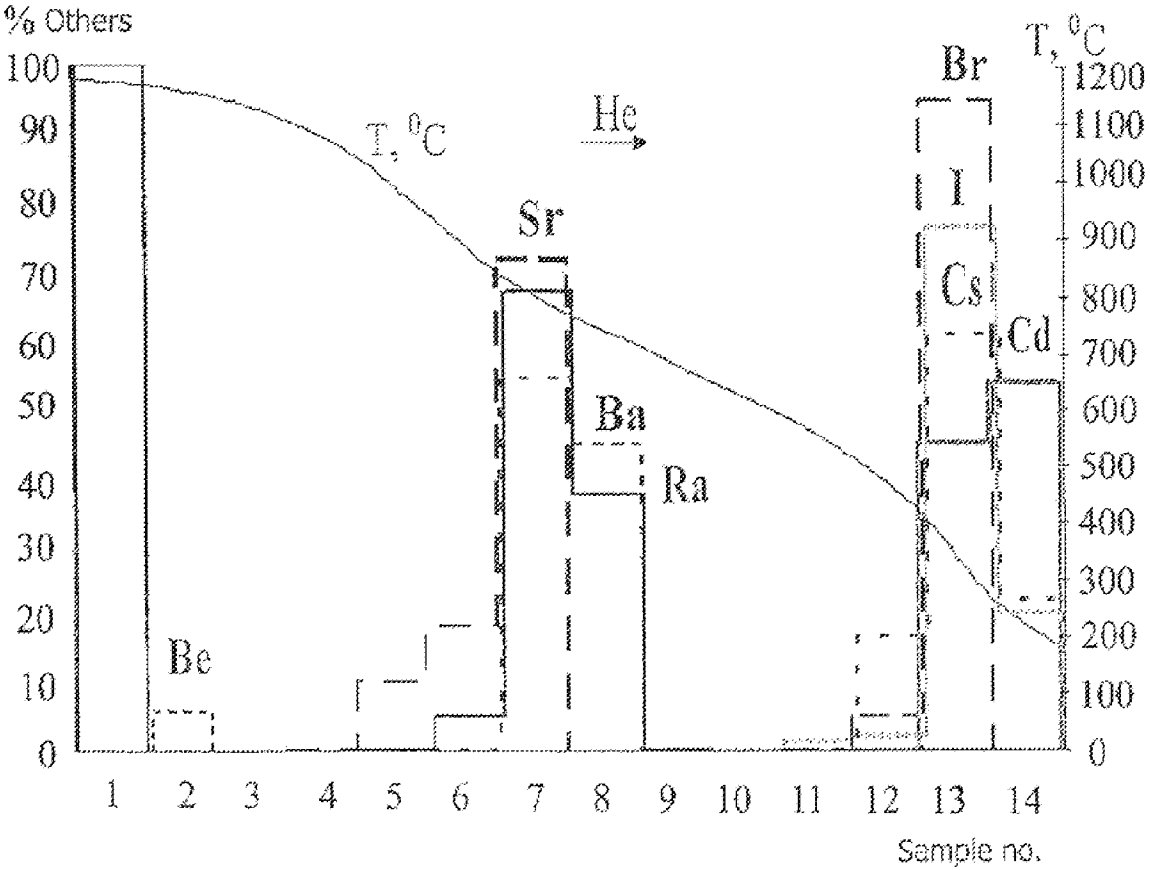

FIG. 8 shows the distribution of elements produced upon thorium irradiation with protons and upon precipitation in a titanium column in flowing helium as a function of temperature.

Figure 9:
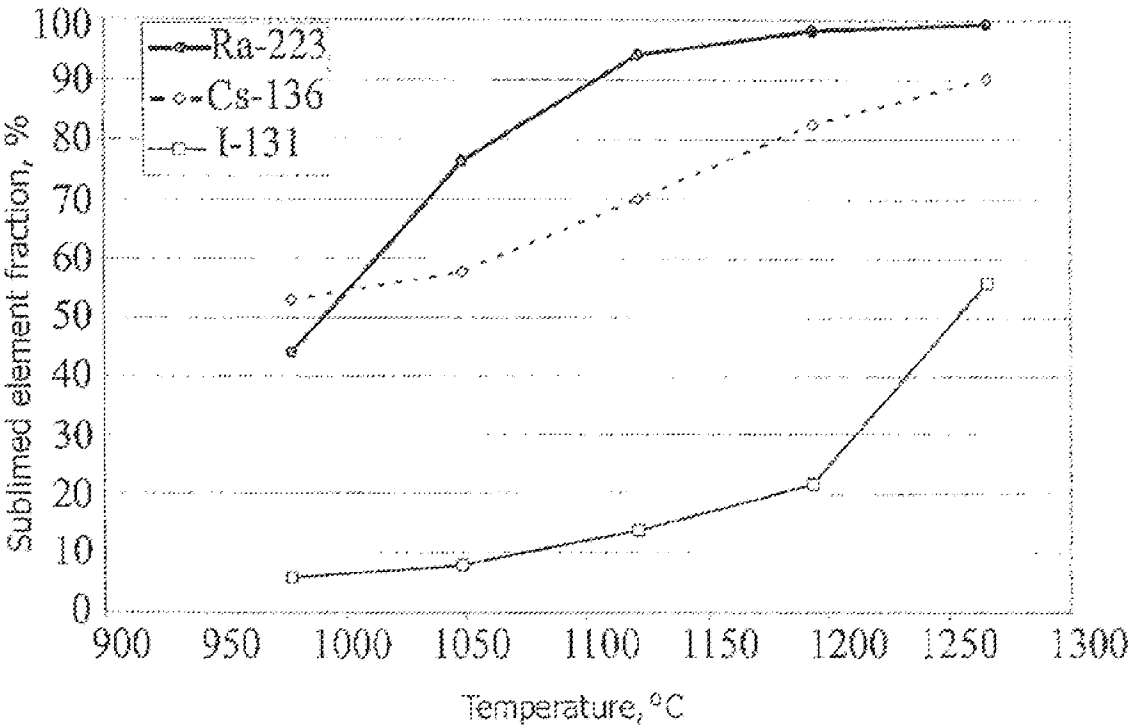

FIG. 9 shows the recovery of radium, as well as iodine and cesium, from a lanthanum-containing melt as a function of temperature (data were obtained from consecutive heatings of one sample at increasing temperatures; each heating lasted 1 h).

Figure 10:
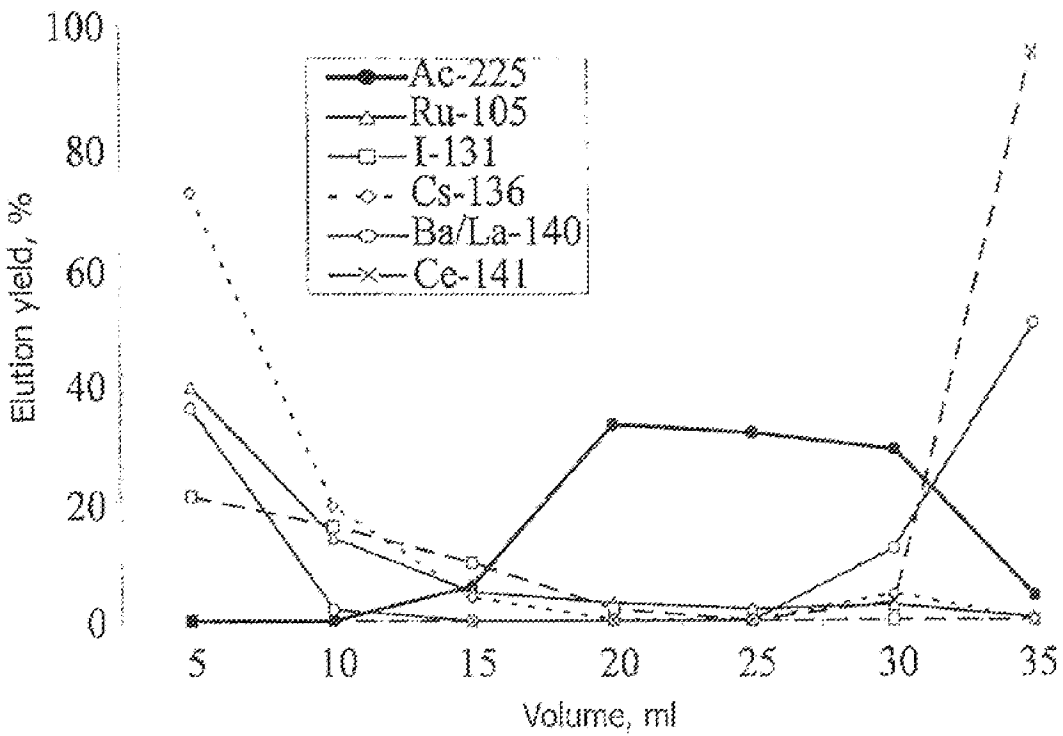

FIG. 10 shows elution curves to illustrate the separation of actinium from the major interfering radionuclides in an extraction-chromatographic column packed with a sorbent coated with carbamoylphosphine oxide.

Through the column passed were:

the initial solution (5 ml of 8 M $HNO_3$);

the eluent (30 ml of 8 M $HNO_3$).

Figure 11A:
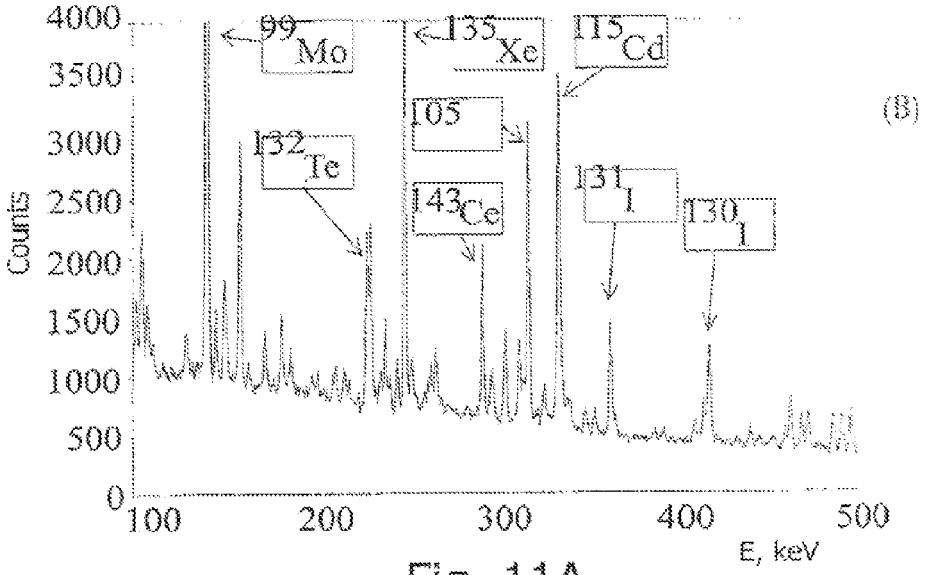
Figure 11B:
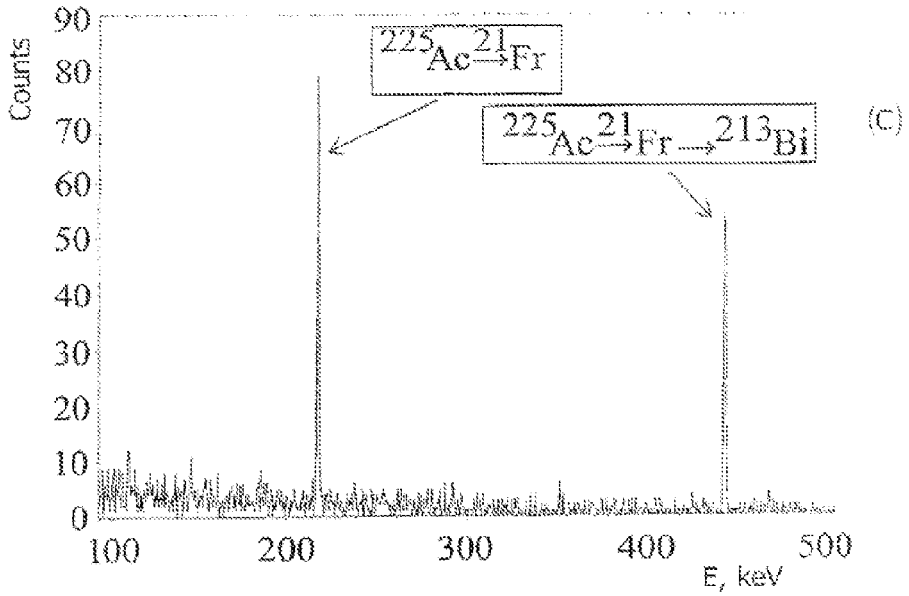
Figure 11C:
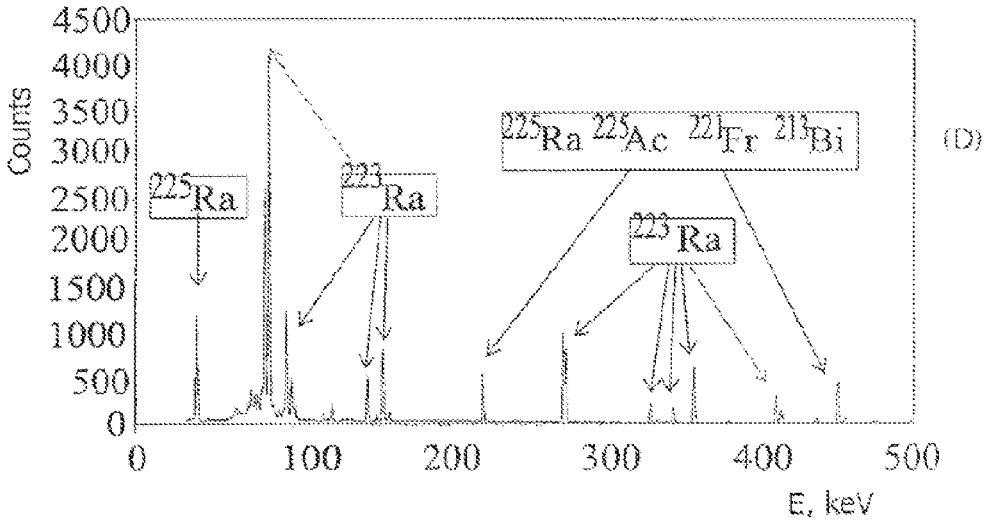

FIG. 11 shows gamma spectra:

in FIG. 11*a*, from an irradiated thorium target (2 days after the irradiation was over);

in FIG. 11*b*, from an actinium fraction recovered from irradiated thorium;

in FIG. 11*c*, from a radium fraction recovered from the irradiated thorium.

CARRYING OUT THE INVENTION

The carrying out of the claimed process for producing actinium-235 and radium isotopes by irradiation with a beam of accelerated charged particles and the target for carrying out the process is supported by further explanations and nonrestrictive examples.

The formation of actinium-235 and radium isotopes upon irradiation of a thorium-containing target with particles having various energies is a well-known fact.

Figure 1:
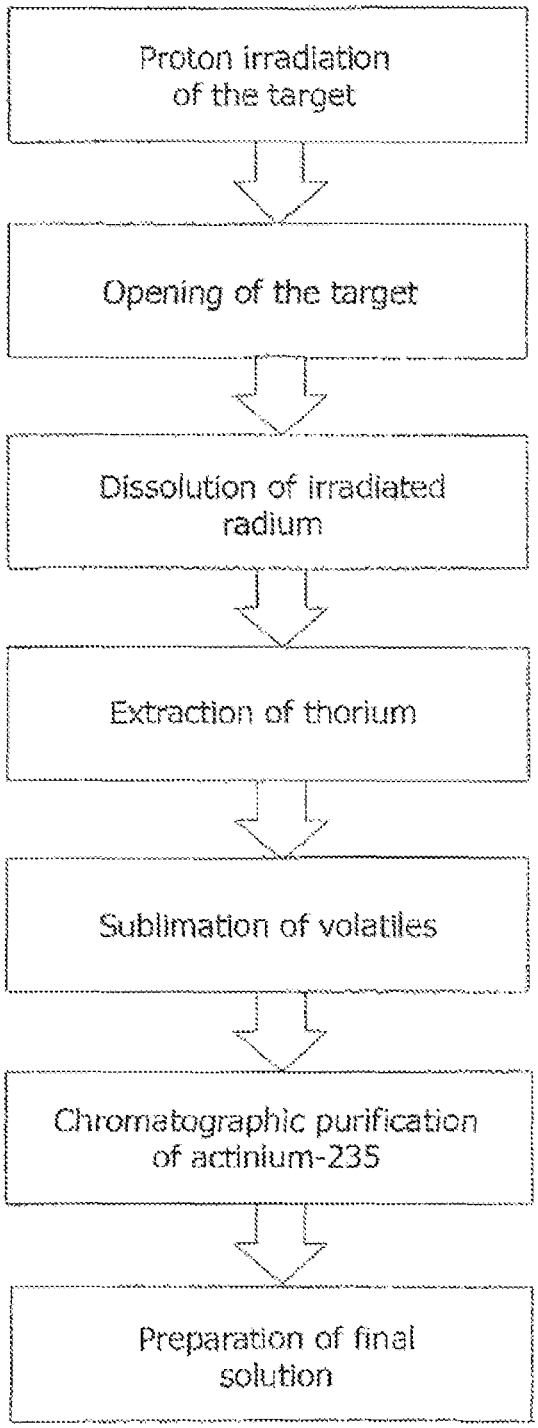
Figure 2:
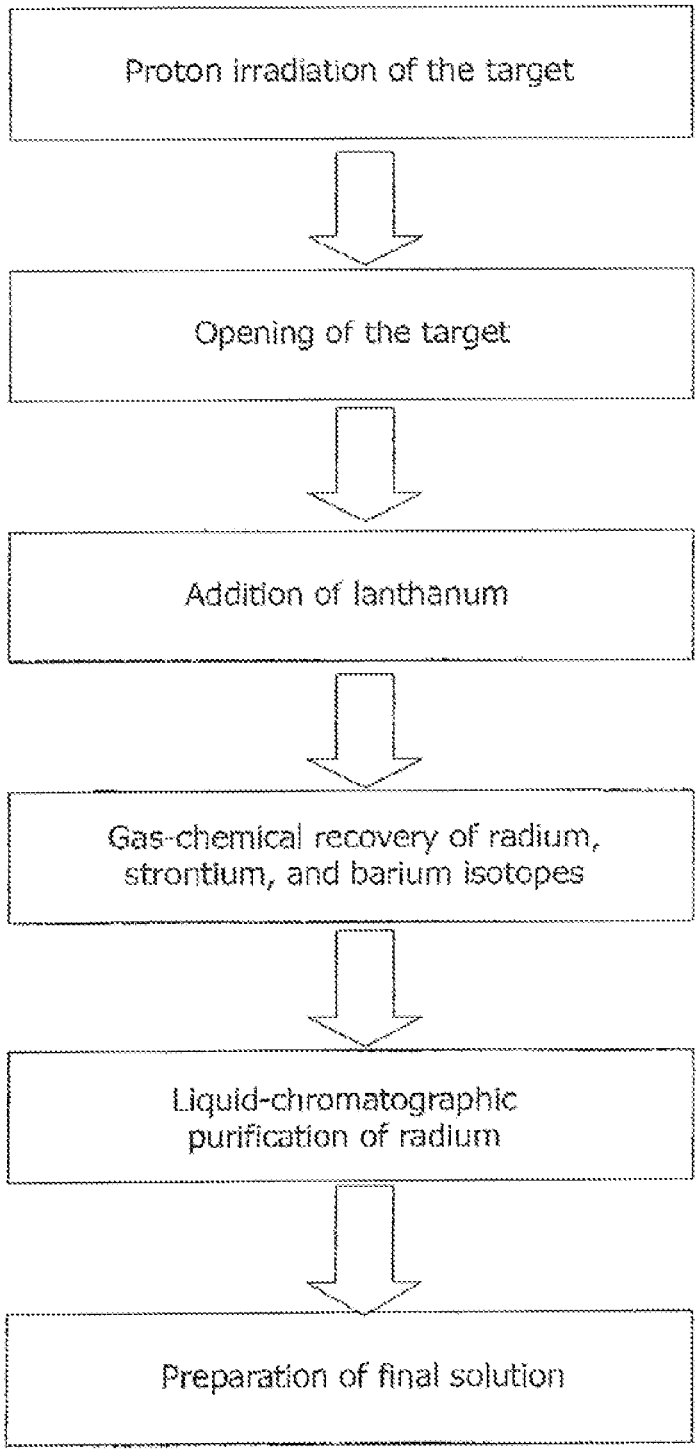
Figure 3:
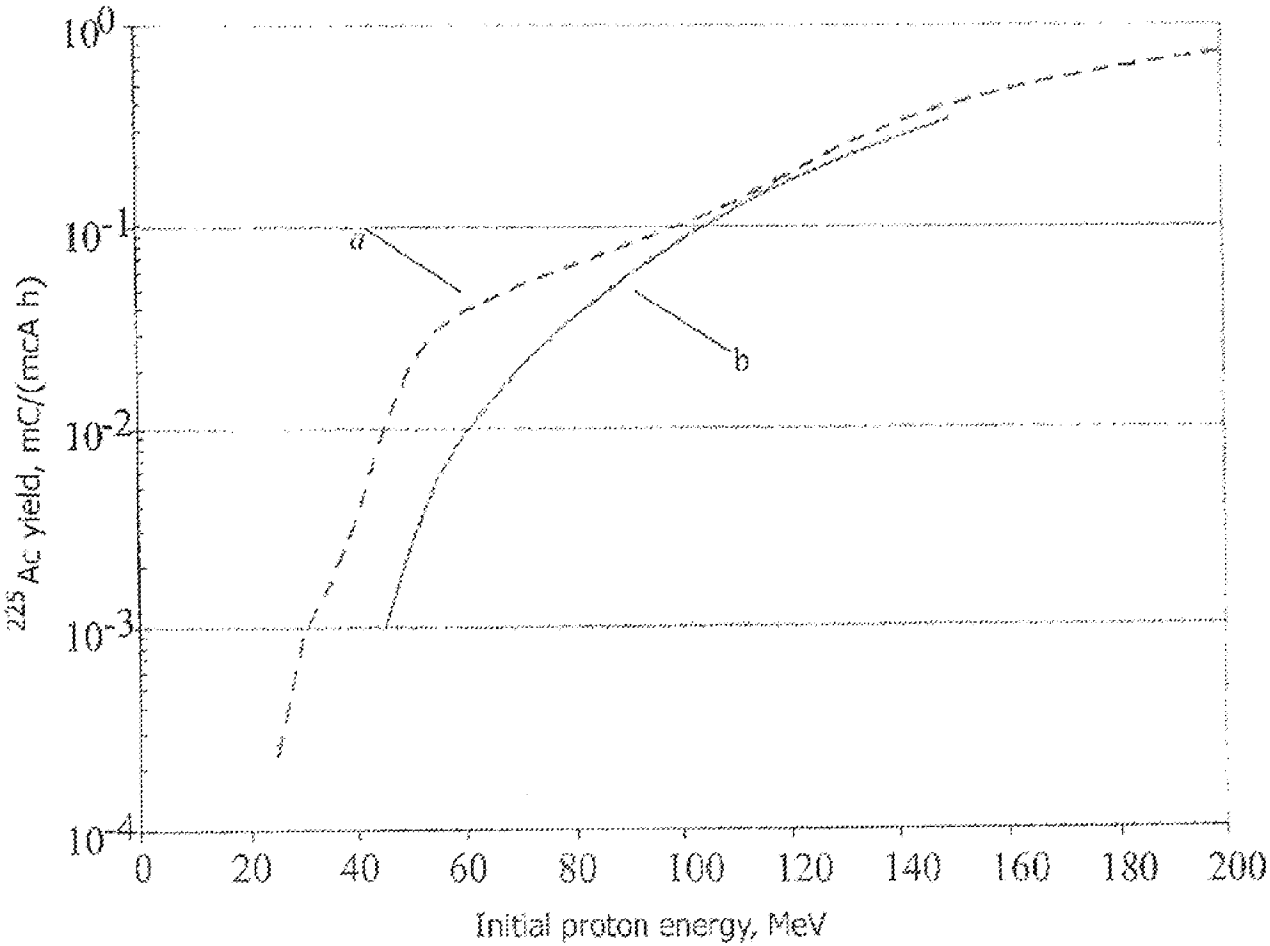
FIG. 3 shows the actinium-235 yield in a thick thorium target as a function of initial proton energy (with a final energy of 20 MeV): (a) a calculated curve and (b) an experimental curve.

FIG. 3 shows the $^{225}$Ac yield in a thick thorium target as a function of initial proton energy (with a final energy of 20 MeV). The figure displays curves obtained from our theoretical calculations and the curve drawn on the basis of our experimental data and available data of other researchers [see M. Lefort et al., Reactions nucleaires de spallation induites sur le thorium par des protons de 150 et 82 MeV, Nuclear Physics, Vol. 25, pp. 216-247, 1961; H. Gauvin, Reactions (p, 2pxn) sur le thorium 232 de 30 a 120 MeV, Journal de Physique, Vol. 24, pp. 836-838, 1963]. From these data, it follows that the yield of actinium-235 (as radium isotopes, too) in a thick target increases abruptly when the initial proton energy exceeds 40 MeV. This is on account of the fact that $^{225}$Ac is produced by nuclear reactions having the following four scenarios:

$$^{232}\mathrm{Th}(p,4n)^{229}\mathrm{Pa}(T_{1/2}=1.4\ \mathrm{days},\alpha,0.25\%)\rightarrow{}^{225}\mathrm{Ac} \quad (1)$$

$$^{232}\mathrm{Th}(p,2p6n)^{225}\mathrm{Ac} \quad (2)$$

$$^{232}\mathrm{Th}(p,p7n)^{225}\mathrm{Th}(T_{1/2}=8\mathrm{min},\beta^{+},10\%)\rightarrow{}^{225}\mathrm{Ac} \quad (3)$$

$$^{232}\mathrm{Th}(p,3p5n)^{225}\mathrm{Ra}(T_{1/2}=14.8\mathrm{days},\beta^{-},100\%)\rightarrow{}^{225}\mathrm{Ac}. \quad (4)$$

The contribution from the last three scenarios increases considerably when proton energies exceed 40 MeV, while the contribution from the first scenario becomes insignificant.

It is evident and commonly known that monolithic metallic thorium is the best target material. Targets made of thorium compounds, for example, thorium oxide, are also useful, but thorium compounds, as a rule, have lower thermal conductivities (for example, 5.7 W/(m K) for thorium oxide at 300° C. against 29 W/(m K) or higher for metallic thorium), thereby deteriorating cooling. Further, use of thorium compounds means a lower percentage of the major component (thorium). This leads to lower product yields.

The calculations and experiments showed that when proton currents exceed 10 μA, the optimal target thickness on the side of the beam is from 2 to 30 mm depending on the initial proton energy, current, and shape of the beam. A thorium target having a thickness less than 2 mm or more than 30 mm is also useful, but product yields with thin targets are noticeably lower whereas thicker targets greatly deteriorate cooling and do not provide a noticeable increase in yield for proton energies lower than 160 MeV.

It is also a common knowledge that targets are cooled with a liquid while being irradiated and are, as a rule, enclosed in air-tight shells. A shell-free thorium target cannot be irradiated with high-intensity currents, because thorium is destroyed by water, and part of the generated activity can enter the cooling liquid. As the target shell material, used was niobium, or high-alloy austenitic steel, or nickel-coated hot-rolled molybdenum, or nickel-coated nonporous graphite. While a target is irradiated with high currents of charged particles, high temperature is developed in the target, which can cause thorium to react with the shell material and give rise to shell destruction. Of the available and efficient materials, metallic thorium is the least reactive at high temperatures with respect to niobium, molybdenum, and graphite, as well as with tungsten (but tungsten is less efficient). Most other metals (specifically, copper, silver, aluminum, and their base alloys) are destroyed when reacting with thorium at high temperature to form intermetallic compounds. Interaction with stainless steel takes place, but is not so significant.

As a rule, targets are cooled with water from various sides during irradiation. In so doing, water is exposed to a high-intensity proton beam, is subject to radiolysis, becomes more chemically reactive, and destroys many materials that do not react with water under ordinary conditions. Shell materials such as molybdenum, tungsten, titanium, aluminum, zinc, and graphite, do not react with ordinary water but are destroyed by water under the effect of a high-intensity proton beam. Copper corrosion is also noticeable. Tantalum has not high radiation resistance. Niobium, stainless steel, and nickel are practically undestroyed by radiolysis water. Therefore, the aforementioned materials, or molybdenum or graphite nickelated on their outer surfaces were used as shell materials. Molybdenum and graphite are attractive on account of having high thermal conductivities (160 and 80 W/(m K) at 300° C., respectively). An experiment showed that the optimal nickel coating thickness was 40 to 100 μm: a layer having a smaller thicknesses could be destroyed during irradiation.

Other shell materials (e.g., copper, copper alloys, silver, precious metals, aluminum, and vanadium) are far worse, as they have lower thermal stability in high-temperature reaction with metallic thorium or the liquid that cools the target during irradiation.

When shells made of metallic materials were used, thorium was diffusion-welded to the metallic shell, thereby improving contact and, accordingly, target cooling. The outer surface of the metallic molybdenum shell was nickelated either electrolytically or via diffusion welding of a nickel foil to the surface of the molybdenum shell. A metallic shell may be additionally sealed by electron-beam, laser, or argon-arc welding. A graphite shell was made air-tight by a radiation-resistant adhesive, and its outer surface was electrolytically coated with nickel.

Radium isotopes ($^{223}$Ra, $^{225}$Ra, and $^{224}$Ra) were recovered from thorium by sublimation upon heating of an irradiated target to a high temperature in a flow of a purified inert gas. In so doing, thorium was doped with metallic lanthanum in order to bring it into a molten state at a temperature of (1100 to 1300° C.) and stabilize radium in a metallic state. Radium sublimation from unfused monolithic thorium at these temperatures occurs far more slowly and is strongly dependent on the thickness of a sample. Sublimation recovery from molten undoped metallic thorium is feasible, but its melting temperature is about 1750° C., which creates technical difficulties in recovery. Further, experiments showed that when undoped metallic thorium was heated, it expelled, along with radium, many other elements thereby contaminating the recovered product, specifically, with some amount of actinium and lanthanides. Heating in the presence of lanthanum is more efficient. Depending on the heating temperature, the lanthanum percentage in the alloy should be not lower than 45 at. % (1100° C.) or not lower than 30 at. % (1300° C.). Heating is carried out in a container made of metallic titanium or zirconium, since many other materials have surface oxide Dims that hamper radium sublimation. Thorium and most other product isotopes (Th, Ac, Pa, La, Mo, Tc, Cr, Ru, Rh, Zr, Nb, Ce, Nd, Te, Sn, Sb, and Ag) do not sublime from the container. Radium, together with barium and strontium isotopes, readily sublimes from the container and can be precipitated on a titanium or zirconium collector at a lower temperature (1000 to 650° C.); complete precipitation is reached at 650° C., whereas isotopes of the other sublimed elements (I, Br, Cs, and Cd) are precipitated at lower temperatures ranging from 600° C. to room temperature, and Be is precipitated at temperatures above 1000° C. (FIG. 8). In this way, Ra, Ba, and Sr are separated from other elements. Then, Ra, Ba, and Sr are washed off the surface of the titanium collector, and Ra is purified from Sr and Ba by liquid chromatography on a column packed with the sorbent Sr Resin (Eichrom). Ba and Sr are sorbed from 4 to 8 M nitric acid, whereas Ra passes through the column.

As a result, a pure radium fraction is obtained.

Radium sublimation from lanthanum-free thorium is feasible, but the yield of radium is reduced; the larger the metallic thorium sample, the greater the degree of reduction. Apart from metallic lanthanum, useful dopants are lanthanides (Ce, Nd, Pr); they have low vapor pressures and are alloyed with thorium at relatively low temperatures, but they are less preferable because of their higher costs, and they are fused with thorium at higher temperatures than lanthanum does. Sublimation from thorium and alloys at higher temperatures is feasible but is more complex technically.

Recovery of radium-223 and actinium-235 can be carried out consecutively from one irradiated target. If gas-chemical processing is first carried out to recover radium, actinium should be then separated from lanthanum using, for example, a method described in [L. N. Moskvin and L. G. Tsaritsyna, Recovery of Actinium and Radium from a Thorium Target Irradiated with 660-MeV-Protons, At. En., Vol. 24, pp. 383-384, 1968] or other known methods, for example, as described in [Molinet R., Janssens W., Apostolidis C., Koch L, Proc. 4$^{th}$ Int. Conf. on Nuclear and Radiochemistry, Saint-Malo, France, Sep. 8-13, 1996]. It is also possible to first separate radium and actinium from thorium, recover actinium by liquid chromatography, and then transfer the other products contained in Ra in the form of nitrate compounds'(the initial eluate volume) into a titanium or zirconium container and recover radium by sublimation as described above.

The carrying out of the claimed process for producing actinium-235 and radium isotopes and the target for implementing the process will be described further by means of the following nonrestrictive examples.

Example 1

Figure 4:
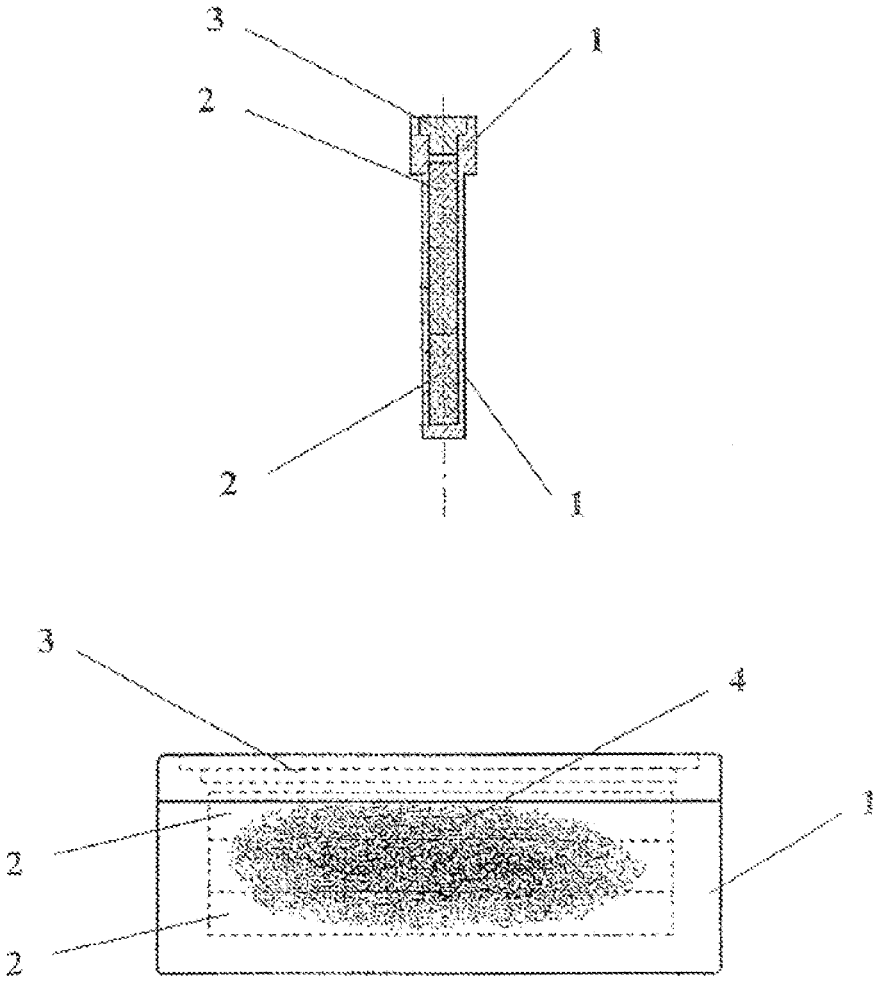

As shown in FIG. 4, into a graphite shell (1) electrolytically coated with nickel (the nickel thickness is 60 μm), tightly inserted are three bulky metallic thorium monoliths (2) shaped as rectangular blocks having a total weight of 54 g; and a target is made air tight by a graphite cover (3) using a high-temperature radiation-resistant adhesive. Then, the target is irradiated with protons in the range of energies from 91 to 58 MeV at an angle of 26° by a current of 50 μA while being cooled with a water flow. The irradiation field is shown by reference (4). Another similar target positioned in front of the first target may be irradiated at the same time in a range of proton energies of from 145 to 123 MeV.

Following irradiation, the target is exposed for 20 days for $^{223}$Ra to pileup, and then processed. The lateral walls of a graphite shell are cut off; the three blocks of irradiated metallic thorium are withdrawn from the shell and transferred to a boat container (10) made of metallic titanium (FIG. 7), to which 30 g of mechanically purified metallic lanthanum is added; then, the container is covered with a cover (11) and placed in a quartz-glass or Alundum tube lined with niobium foil. The container is heated by furnaces (8) at 1200° C. in flowing helium, which is purified by means of a zirconium getter (9) (at 600 to 700° C.), thereby precipitating sublimed radium, together with c $^{140}$Ba and Sr isotopes, onto titanium foil (13) at temperature not lower than 650° C. Other products, such as $^{126,131}$I, $^{132,134,136}$Cs, and $^{115}$Cd, pass through the radium precipitation zone and precipitate onto titanium foil (14) at temperature lower than 600° C. Most part of the radioisotopes remains inside the titanium container in an alloy (12) together with thorium and lanthanum. FIG. 8 illustrates the thermochromatographic separation of the products recovered from thorium in another (model) experiment. FIG. 9 shows the radium recovery from melt as a function of temperature.

Then, radium, together with barium, is washed off the titanium foil with (1) ml of 7 M nitric acid, and the solution is admitted to a column packed with the sorbent Sr Resin, in a volume of 2.5 ml; next, the column is washed with 6 ml of 7 M nitric acid, and radium is eluted with 6 ml of 7 M nitric acid. Barium and strontium are retained in the column.

The yield into $^{223}$Ra in irradiation was about 6 mC/h (by the 6th day after the irradiation was over); the chemical yield of radium was higher than 95%.

In 25 days after irradiation, the product contained $^{223}$Ra with minor $^{225}$Ra (about 2% based on activity) and actinium produced therefrom, as well as less than 1% 224Ra. The gamma spectrum of the product is shown in FIG. 11*c*.

Example 2

A target is manufactured (FIG. 5). A bulk metallic thorium monolith (2) shaped as a disk 7 mm thick and 45 mm in diameter is vacuum diffusion welded to inlet windows (5) made of a hot-rolled molybdenum foil 100 μm thick electrolytically coated with nickel (the nickel thickness is 60 μm). Temperature is about 900° C.; the specific pressure is 280 kg/cm$^2$. The welded part is additionally sealed by electron-beam welding with niobium rings (6) 0.5 mm thick. The target is irradiated by a proton beam directed normal to the target with a current of 100 μA and an initial energy of 110 MeV.

Following irradiation, nickel is etched off with 1 M nitric acid for 2 hours, and the inlet and outlet windows (5) are dissolved in 100 ml of 50% hydrogen peroxide.

After being withdrawn from the shell (1') made of niobium or nickel-coated hot-rolled molybdenum, thorium is dissolved in concentrated nitric acid under heating, the medium is brought to 5 M nitric acid (the solution volume reaches 0.5 l), and then 100 ml of tributyl phosphate is added to transfer thorium, zirconium, and niobium to the organic phase. Following the extraction, the solution is separated into an aqueous phase and an organic phase, and the extraction is repeated two more times. Next, the aqueous phase is concentrated to dryness, concentrated hypobromic acid is added, again concentrated to dryness to remove ruthenium in the form of tetroxide, the residue is dissolved in 3 ml of 8 M nitric acid, and admitted to a column 0.5 cm in diameter and 5 cm long packed with an extraction/chromatographic sorbent coated with a carbamoylphosphine oxide layer (TRU Resin, Eichrom); the column is washed with 15 ml of 8 M nitric acid (some radionuclides, specifically, Cs, Ba, and Ra, leave the column), and then actinium is eluted with 20 ml of 8 M nitric acid (FIG. 10). The eluate is concentrated; the residue is dissolved in 0.5 ml of 8 M nitric acid and chromatographed again.

The activity yield of actinium-235 reached 8 mC/h by the end of irradiation.

The chemical yield was 93%; the radionuclide purity of the product (by the 17th day following the end of irradiation) was as follows:

for $^{226}$Ac (half-life period of 29 h), 0.2%;

for $^{227}$AC (half-life period of 21.8 years), ≤0.1%;

for other radionuclides detected by alpha and gamma spectroscopy, <0.1%.

Example 2 describes a target enclosed in a molybdenum shell and the processing thereof to recover actinium-235 with use of extraction by tributyl phosphate.

Example 3

A target is manufactured (FIG. 6), comprising a bulk metallic thorium monolith (2) shaped as an elliptic plate 4.5 mm thick diffusion-welded to a foil (5) made of austenitic stainless steel inside a case (1) made of austenitic stainless steel. The target is additionally sealed along the perimeter thereof by means of an argon-arc welded L-shaped stainless steel ring (7).

The target is irradiated in a proton accelerator with a current of 70 μA and proton energies in a range of from 100 to 80 MeV.

Following the withdrawal from the shell, thorium is dissolved in concentrated nitric acid under heating, the medium is brought to 4 M nitric acid (the solution volume reaches 1 l), and an equal volume of a 0.5 M solution of tri-n-octylphosphine oxide in toluene is added. Following the extraction, the solution is separated into an aqueous phase and an organic phase, and the extraction is repeated one more time. The aqueous phase is concentrated to dryness, concentrated perchloric acid is added, the solution is again concentrated to dryness, the residue is dissolved in 2 ml of 8 M nitric acid, the solution is admitted to a column 0.5 cm in diameter and 5 cm long packed with an extraction/chromatographic sorbent coated with a carbamoylphosphine oxide layer (TRU Resin, Eichrom), the column is washed with 15 ml of 8 M nitric acid, and then actinium is eluted with 20 ml of 8 M nitric acid. The eluate is concentrated, dissolved in 0.5 ml of 8 M nitric acid, and again chrornatographed.

The chemical yield of actinium-235 was 90%; the radionuclide purity of the product (by the 18th day after irradiation) was as follows:

for $^{226}$Ac (half-life period of 29 h), 0.1%;

for $^{227}$Ac (half-life period of 21.8 years), ≤0.1%;

for other radionuclides detected by alpha and gamma spectroscopy, <0.1%.

This example demonstrates a thorium target enclosed in a stainless steel shell and the chemical processing thereof with use of extraction by tri-n-octylphosphine oxide.

Thus, the present invention provides a high-yield production of actinium-235 and radium isotopes, having high purity with respect to both radioactive and stable impurities, from bulk thorium targets irradiated with a high-intensity beam of charged particles, with the goal of further using in therapeutic treating of oncologic diseases. The radionuclide purity of actinium achieved by a certain date after irradiation amounts to 99.7% or higher, and the radionuclide purity of radium-223 (which contains minor radium-224 and radium-225) exceeds 95%.

The invention claimed is:

1. A target for implementing a process for producing actinium-225 and radium isotopes, the target comprising a thorium metal sample enclosed in a hermetic shell, the sample being in the form of at least one bulk thorium metal monoliths that is 2 to 30 mm thick, the hermetic shell having walls with a wall thickness on a beam inlet and outlet side in a range of 50 to 300 μm, the walls of the shell being diffusion-welded to the sample so as to provide a contact between the sample and the shell that enables improved cooling of the target with a flow of water around the walls than if the walls were not diffusion-welded to the sample, the target further comprising an electron-beam, laser, or argon-arc weld seam sealing the walls to the sample at a periphery of the target, the hermetic shell being arranged and constructed with a material that does not react either (a) with thorium under thermal and radiation loads resulting from an irradiation of the sample with protons at an energy above 40 MeV while the target is being cooled with the water flow or (b) with radiolytic water from the water flow when the target is cooled with the water flow during the irradiation, said material being selected from the group consisting of metallic niobium, nickelated molybdenum, and high-alloy austenitic steel.

2. The target according to claim 1, wherein the hermetic shell is made of hot-rolled molybdenum comprising, on top of the hermetic shell made of hot-rolled molybdenum, a protective layer of metallic nickel having a thickness within a range from 40 to 90 μm.

3. The target process according to claim 1, wherein the material is metallic niobium.

4. The target process according to claim 1, wherein the material is high-alloy austenitic steel.

5. The target process according to claim 1, wherein the material is hot-rolled molybdenum.

6. A system comprising (i) the target according to claim 1;

(ii) a proton beam source for generating proton beams at an energy above 40 MeV, said proton beam source being positioned for irradiating the target; and (iii) a water flow source that provides a flow of water for cooling the target while it is being irradiated by protons from the proton beam source, wherein the target is constructed and arranged such that, when the thorium monolith is irradiated with proton beams from the proton beam source at an energy above 40 MeV and the irradiated thorium is withdrawn from the shell, a yield of at least 93% of actinium can be recovered from the thorium by a chemical process comprising dissolving the thorium in nitric acid under heating, extracting with tributyl phosphate and separating by chromatography.

* * * * *